US006695591B2

(12) United States Patent
Grimmer et al.

(10) Patent No.: US 6,695,591 B2
(45) Date of Patent: Feb. 24, 2004

(54) MULTI-STAGE GAS COMPRESSOR SYSTEM

(75) Inventors: John E. Grimmer, Trafalgar, IN (US); Edward T. Ketcham, Greenwood, IN (US)

(73) Assignee: Grimmer Industries, Inc., Franklin, IN (US)

( * ) Notice: Subject to any disclaimer, the term of this patent is extended or adjusted under 35 U.S.C. 154(b) by 46 days.

(21) Appl. No.: 10/151,536

(22) Filed: May 20, 2002

(65) Prior Publication Data

US 2003/0215339 A1 Nov. 20, 2003

(51) Int. Cl.[7] ..... F04B 23/14; F04B 25/00; F04B 25/04; F04B 17/00

(52) U.S. Cl. ..... 417/203; 417/205; 417/243; 417/253; 417/252; 417/266; 417/313; 417/362

(58) Field of Search ..... 417/203, 205, 417/243, 254, 252, 248, 251, 266, 313, 362

(56) References Cited

U.S. PATENT DOCUMENTS

| | | | | |
|---|---|---|---|---|
| 3,072,317 A | | 1/1963 | Kodra | |
| 3,131,855 A | * | 5/1964 | Kocher | 417/265 |
| 3,136,477 A | | 6/1964 | Nicholas | |
| 3,250,458 A | | 5/1966 | Caldwell | |
| 3,265,294 A | | 8/1966 | Hunt | |
| 3,606,569 A | | 9/1971 | Wallace | |
| 4,082,477 A | | 4/1978 | Kronogard | |
| 4,089,173 A | | 5/1978 | Melchior et al. | |
| 4,480,968 A | | 11/1984 | Duerr | |
| 4,496,291 A | | 1/1985 | Grimmer | |
| 4,815,950 A | | 3/1989 | Aoki et al. | |
| 4,832,578 A | | 5/1989 | Putt | |
| 5,033,940 A | * | 7/1991 | Baumann | 417/273 |
| 5,066,202 A | * | 11/1991 | Berges et al. | 417/228 |
| 5,314,314 A | | 5/1994 | Hinkle | |
| 5,400,751 A | | 3/1995 | Grimmer et al. | |
| 5,676,180 A | | 10/1997 | Teel | |
| 5,908,141 A | | 6/1999 | Teel | |
| 6,050,094 A | | 4/2000 | Udd et al. | |
| 6,079,952 A | | 6/2000 | Harte et al. | |
| 6,089,830 A | | 7/2000 | Harte et al. | |
| 6,203,285 B1 | * | 3/2001 | Wagner et al. | 417/243 |
| 6,227,823 B1 | | 5/2001 | Paul et al. | |
| 6,345,503 B1 | | 2/2002 | Gladden | |
| 6,345,965 B1 | | 2/2002 | Sagar | |
| 6,398,518 B1 | | 6/2002 | Ingistov | |
| 6,589,024 B2 | * | 7/2003 | Nishikawa et al. | 417/273 |

* cited by examiner

*Primary Examiner*—Charles G. Freay
(74) *Attorney, Agent, or Firm*—Brinks Hofer Gilson & Lione

(57) ABSTRACT

A multi-stage compressor comprises a gas compressor, a centrifugal blower having an input connected with a gas source and an output connected with the gas compressor and providing a flow of compressed gas as a first stage of compression to the gas compressor, and a power source mechanically connected with and driving both the centrifugal blower and gas compressor to provide multi-stage compression of said gas.

17 Claims, 3 Drawing Sheets

MULTI-STAGE GAS COMPRESSOR SYSTEM

FIELD OF THE INVENTION

This invention relates to multi-stage gas compressors for providing compressed gas at high flow rates and high pressures.

BACKGROUND OF THE INVENTION

Many varied construction and maintenance activities benefit from the use of portable engine-driven gas compressors. For example, in servicing oil and gas wells, compressed air at high flow rates and high pressures is used to blow collected debris that is interfering with the flow of oil or gas from the well, and compressed air at substantially lower pressures, is used in maintaining structures exposed to the elements, for example, in sand blast cleaning and painting of steel bridges. Because such activities take place in remote locations, gas compressors are frequently engine-driven and carried by trailers or truck beds to the site of their use. Since the engine-driven gas compressors are operated in locations remote from sources of gasoline and diesel fuel, it is important that they provide maximal supplies of compressed gas with minimal fuel usage. It is important that such portable gas compressors be as efficient and reliable as possible, that they be as small and light as possible, and that their initial and operating costs be as low,as possible.

A number of compressed gas generators adapted for such remote use have been disclosed.

U.S. Pat. No. 4,496,291 discloses a compound turbocharger system for supplying air under pressure to an engine/compressor unit of the type illustrated in U.S. Pat. No. 4,232,997. The disclosed engine/compressor unit comprises a converted V-8 compression ignition engine, such as that manufactured by the Cummins Engine Company, Inc. of Columbus, Ind., and identified by their designation V-903.In such converted engine/compressor units, one bank of cylinders is left in its normal condition for operation as an internal combustion engine while the opposite bank of cylinders is modified so each modified cylinder can operate as an air compressor cylinder. More particularly, a new head for the compressor bank and valve operating arrangement is provided. Each cylinder in the compressor bank is isolated from the engine fuel supply, and valves are provided to cause air to be supplied to each compression cylinder during the corresponding piston downstroke and to cause compressed air to be exhausted from each cylinder during the corresponding piston upstroke. The air discharged from the compressor bank of cylinders is collected by an outlet manifold and may be supplied to a storage tank or to an apparatus utilizing or driven by compressed air.

In the compound turbocharger system disclosed by U.S. Pat. No. 4,496,291, two or more turbochargers driven by the exhaust gas from the bank of cylinders operating as an internal combustion engine compress atmospheric air and deliver the flow of compressed air to both the bank of cylinders operating as an internal combustion engine and the bank of cylinders operating as an air compressor.

By applying two specifically configured turbochargers in series to an engine-driven compressor such as that disclosed in U.S. Pat. No. 4,496,291, the output of the compressor can be increased by 33%; however, gains in performance of such systems are limited by the pressures and temperatures imposed on the engine exhaust system and only slight improvements can be further realized using current technology with the system of U.S. Pat. No. 4,496,291.

Another multi-stage compressor system with a monoblock construction is disclosed in U.S. Pat. No. 5,400,751, issued Mar. 28, 1995 to John Grimmer et al.

Other prior art systems include, for example, converted V-8 engine blocks which are modified so that all eight cylinders act as air compression cylinders, with all of the cylinders of one bank of cylinders operating in parallel to provide one stage of compression and with the cylinders of the second bank of cylinders operating in series to provide additional stages of compression that compress gas received from the first bank of cylinders. Thus, when the crankshaft of such a converted V-8 engine block is driven by an external power source, air supplied to the first bank of cylinders is compressed by their pistons and delivered to the second bank of cylinders for further stages of compression by the pistons and cylinders of the second bank of cylinders. In converting such engine blocks to a multi-stage compressor, the cylinders provide progressively smaller diameters and volumes so they may further compress the compressed gas received from the upstream compression cylinders. The sizing of the reciprocating pistons to keep operating temperatures within acceptable limits is known in the compressor art. One such system is sold by Hurricane Compressors of Franklin, Ind., as Production Model 903-84, which develops 330 cu. ft. per minute of compressed air taken from standard atmospheric pressure to 2000 psi and requires about 68 hp per 100 cu. ft. of compressed gas output.

Improved multi-stage gas compression systems which may be adapted to portable use with decreased size, improved reliability, improved efficiency and lower initial and operating costs are needed by industry.

BRIEF DESCRIPTION OF THE INVENTION

This invention provides multi-stage, high flow gas compressors providing increased reliability and efficiency, reduced size and reduced initial and operating costs. In the invention, a centrifugal blower is used to provide a first stage of compression and to delivery a flow of compressed air for further compression in one or more additional stages of compression.

For example, a multi-stage, high flow, high pressure gas compressor can comprise an internal combustion engine block having a plurality of cylinders, each of the plurality of cylinders containing a reciprocatable piston connected to a crank shaft that may be driven by an external power source to reciprocate within the cylinder. Each of the cylinders can be provided with valve means to control the flow of gas into and out of the cylinder, and the cylinders of the engine block can be interconnected in series so their pistons, when driven, further compress a flow of compressed gas directed to a first one of the plurality of cylinders to provide a compressed gas output, and a centrifugal blower can provide a flow of compressed gas to the first one of the cylinders of the internal combustion engine block as a first stage of compression, the centrifugal blower being driven by a mechanical drive connected between the crankshaft of the internal combustion engine block and the centrifugal blower, and the centrifugal blower and mechanical drive can be adapted to provide compressed gas for further compression at flow rates of several hundred cubic feet per minute.

A preferred embodiment of such a system of the invention comprises a five stage, high flow rate, high pressure compressor. In the preferred embodiment, an internal combustion engine V-block having a plurality of cylinders in two banks, including pistons connected with a crankshaft driven by an external power source and valve means to control the flow of gas into and out of the cylinders, is adapted to compress gas in a plurality of stages. A centrifugal blower provides a compressed gas output as a first stage of compression, and the centrifugal compressor is driven by a two step shiv connected between the crankshaft of the internal combustion engine and the centrifugal blower, capable of rotating the centrifugal blower at high speeds, e.g., in excess of 9,000 rpm. The preferred embodiment of the invention further includes first means connecting the centrifugal blower output with an intake manifold for the cylinders of one bank of cylinders of the V-block, and the pistons of the one bank of cylinders operate in parallel as a second stage of compression to further compress the gas output of the centrifugal blower. The further compressed gas from the second stage cylinders is exhausted from the one bank of cylinders and a second means directs the further compressed gas to one or more of the cylinders of the second bank of cylinders. The one or more cylinders of the second bank of cylinders have volumes smaller, progressively, than the cylinders of the first bank of cylinders and operate with their pistons as third, fourth and fifth stages of compression of the compressed gas. Third and fourth means interconnect the progressively smaller cylinders of the second bank of cylinders, which provides from the fifth stage cylinder a compressed gas output at high flow rates and high pressures. The first, second, third and fourth means interconnecting the compression stages of the five stage compressor preferably comprise intercoolers and moisture separators, and can be provided with relief valves to prevent interstage pressures from exceeding undesirable limits and remotely operable dump valves for removing interstage pressures from the system.

Such preferred five stage compressor of the invention can provide outputs up to 1000 cu. ft. per minute at discharge pressures up to 2,000 psi with an input power of only about 59 hp per 100 cu. ft. per minute, and the external power source driving the compressor can be either an internal combustion engine, an electric or hydraulic motor, or power take-off.

Systems of the invention also include controls for the external power source that drives the crankshaft of the gas compressor, and for interstage pressure regulators and dump valve operators.

A preferred two-stage embodiment of the invention comprises a gas compressor assembly including an internal combustion engine, a centrifugal blower driven by a mechanical connection from the internal combustion engine and providing a compressed gas output as a first stage of compression, and a rotary screw compressor driven by a mechanical connection from the internal combustion engine, having an input connected with the compressed gas output of the centrifugal blower and providing a second stage of compression. Such two-stage gas compressor assemblies permit the use of a smaller and less expensive diesel engine, as well as a smaller and less expensive rotary screw compressor. For example, such a preferred two-stage compressor can provide 750 cu. ft. per minute of compressed air at in excess of 100 psi gauge pressure, with a cost saving of about $8000, even with the additional costs of the centrifugal blower and an intercooler. The power required to drive such a two-stage gas compressor of the invention is 5% less than a conventional two-stage twin screw compressor of like capacity, and the weight of such portable two-stage gas compressor systems can be 1,500 lbs. lighter than a conventional portable compressor of similar performance. To achieve 750 cfm, the centrifugal blower must provide 18 psi. With larger centrifugal blowers and properly sized rotary screw compressors and engines, delivery of several thousand cfm may be achieved.

Other features and advantages of the invention will be apparent from the drawings and more detailed description of the invention which follow.

DETAILED DESCRIPTION OF THE BEST KNOWN MODE FOR CARRYING OUT THE INVENTION

Figure 1:
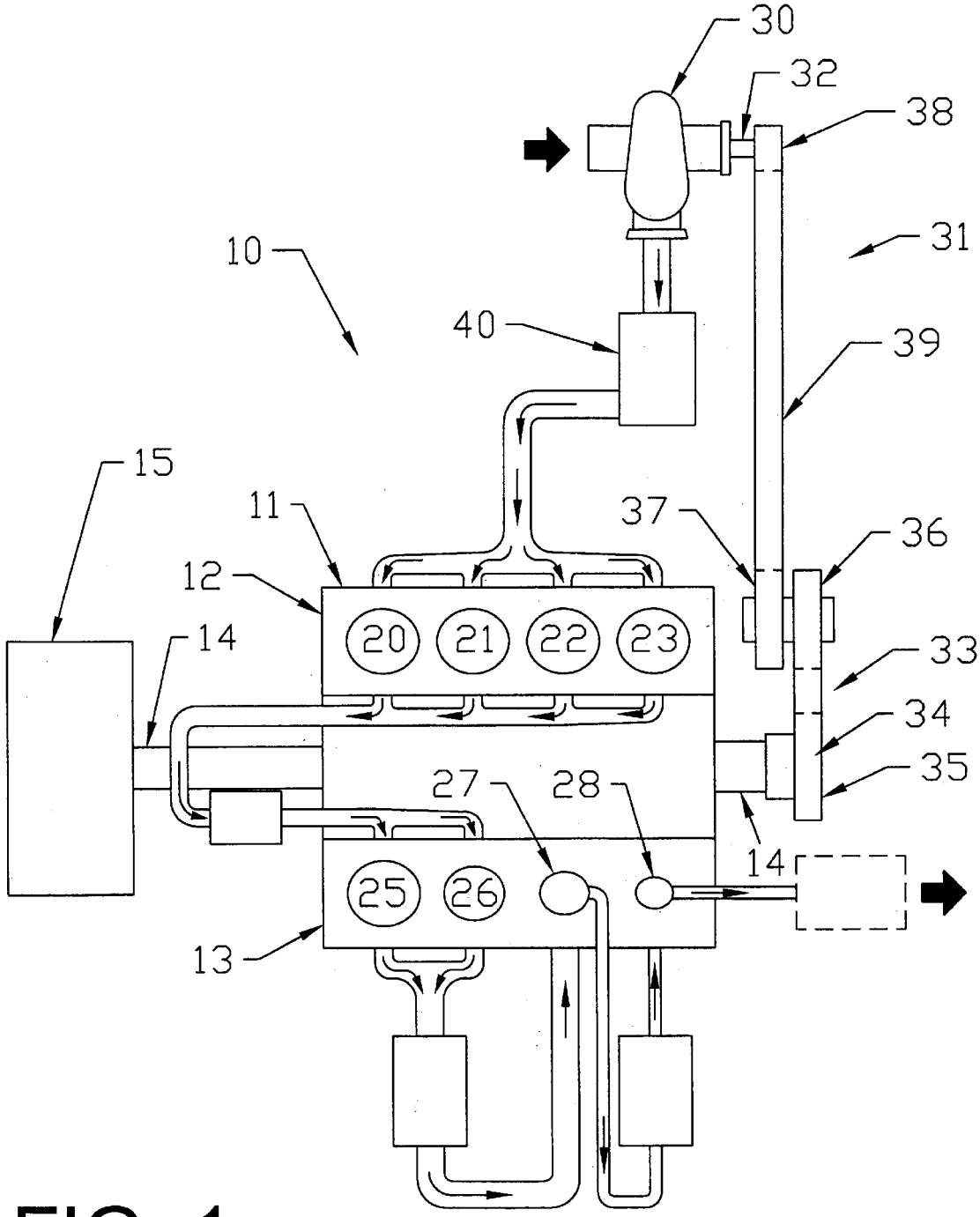
FIG. 1 is a diagrammatic drawing of a preferred five stage, high flow rate, high pressure compressor of the invention.

FIG. 1 is a diagrammatic illustration of one preferred compressor 10 of the invention. The compressor 10 illustrated in FIG. 1 includes an internal combustion engine block 11, which has a plurality of cylinders, with each of the cylinders containing a reciprocatable piston connected with and driven by a crankshaft 14 that may be driven by an external power source 15. In the compressor 10 of this invention, the internal combustion engine block 11 has been converted to be part of the multi-stage compressor 10.

In the preferred five stage compressor 10 illustrated in FIG. 1, the internal combustion engine block comprises a V-block, which includes eight cylinders with four cylinder-pistons 20, 21, 22, 23 in a first bank of cylinders 12 and four cylinder-pistons 25, 26, 27, 28 in a second bank of cylinders 13. Each of the cylinders is provided, as known in the art, with valve means to control the flow of gas into and out of the cylinders. The first bank of cylinders 12 in the preferred five stage embodiment of the invention is provided with a new head providing passages and intake valves for delivering gas to cylinders 20, 21, 22, 23 and exhaust valves for directing compressed gas from cylinders 20, 21, 22, 23. The second bank of cylinders 13 is provided with a new head providing passages and intake and exhaust valves for delivering gas to and exhausting gas from cylinders 25, 26, separate intake and exhaust valves and manifolds for cylinder-piston 27 and separate intake and exhaust valves and manifolds for cylinder-piston 28. The intake and exhaust valves for the cylinders 25, 26, 27 and 28 of the second bank are also operated by the crankshaft as known in the art. As converted, the V-block 11 comprises four stages of gas compression.

The five stage compressor further includes, as a first stage, a centrifugal blower 30 which is driven from the crankshaft 14 of the block 11 by a mechanical connection 31 between the crankshaft 14 and an axle 32 of the centrifugal blower. In the preferred five stage compressor system illustrated in FIG. 1, the mechanical connection 31 preferably includes a belt drive system including a two-step shiv 33 including a first belt 34 between a first pulley 35 connected to crankshaft 14 and a second pulley 36, and a second belt 39 connected between a third pulley 37 driven by the second pulley 36 and a fourth pulley 38 connected with the axle 32 of the centrifugal blower 30 to step up the rate of rotation between the crankshaft 14 and the axle 32 of the centrifugal blower. In the preferred embodiment of this invention, the two-step shiv and belt design provides the required "belt rap" and rate of rotation step-up to run the blower, providing compressed gas at high flow rates of more than 600 cu. ft. per minute, generally at speeds of 10,000 rpm and higher from crankshaft speeds on the order of 1800 rpm.

One preferred centrifugal blower may be obtained from Accessible Technologies, Inc. of Kansas City, Mo., their Model No. P-ISC, which can provide output pressures of from about 9–10 psi and output flow rates of about 600 cu. ft. per minute and more.

As shown in FIG. 1, the cylinders of the block 11 are interconnected in series so their pistons, when driven, further compress the flow of compressed air from centrifugal blower 30. More specifically, with respect to the five stage compressor 10 illustrated in FIG. 1, cylinder-pistons 20, 21, 22, 23 of the first bank of cylinders 12 of the V-block engine 11 operate in parallel as the second stage of compression of the compressed gas received from the first stage centrifugal blower 30, and cylinder-pistons 25, 26 receive the compressed gas from cylinders 20, 21, 22, 23 and operate as a third stage of compression, delivering the further compressed gas to a further cylinder-piston 27 operating as a fourth stage of compression, which delivers its still further compressed gas to an output cylinder-piston 28 operating as the fifth stage of compression to deliver gas at pressures on the order of 2000 psi and at flow rates of up to 1,000 cu. ft. per minute. As illustrated by FIG. 1, the third stage cylinder-pistons 25, 26 have a smaller diameter and provide a smaller volume than the second stage cylinder-pistons 20, 21, 22, 23. The fourth stage cylinder-piston 27 has a smaller diameter and provides a smaller volume than the third stage cylinder-pistons 25, 26 and the fifth stage or output cylinder-piston 28 has a smaller diameter and provides a smaller volume than the fourth stage cylinder-piston 27. In preferred embodiments of this invention, the pistons of each of the cylinders 20, 21, 22, 23 and 25, 26, 27, 28 operate off crankshaft 14 with the same stroke lengths.

Figure 2:
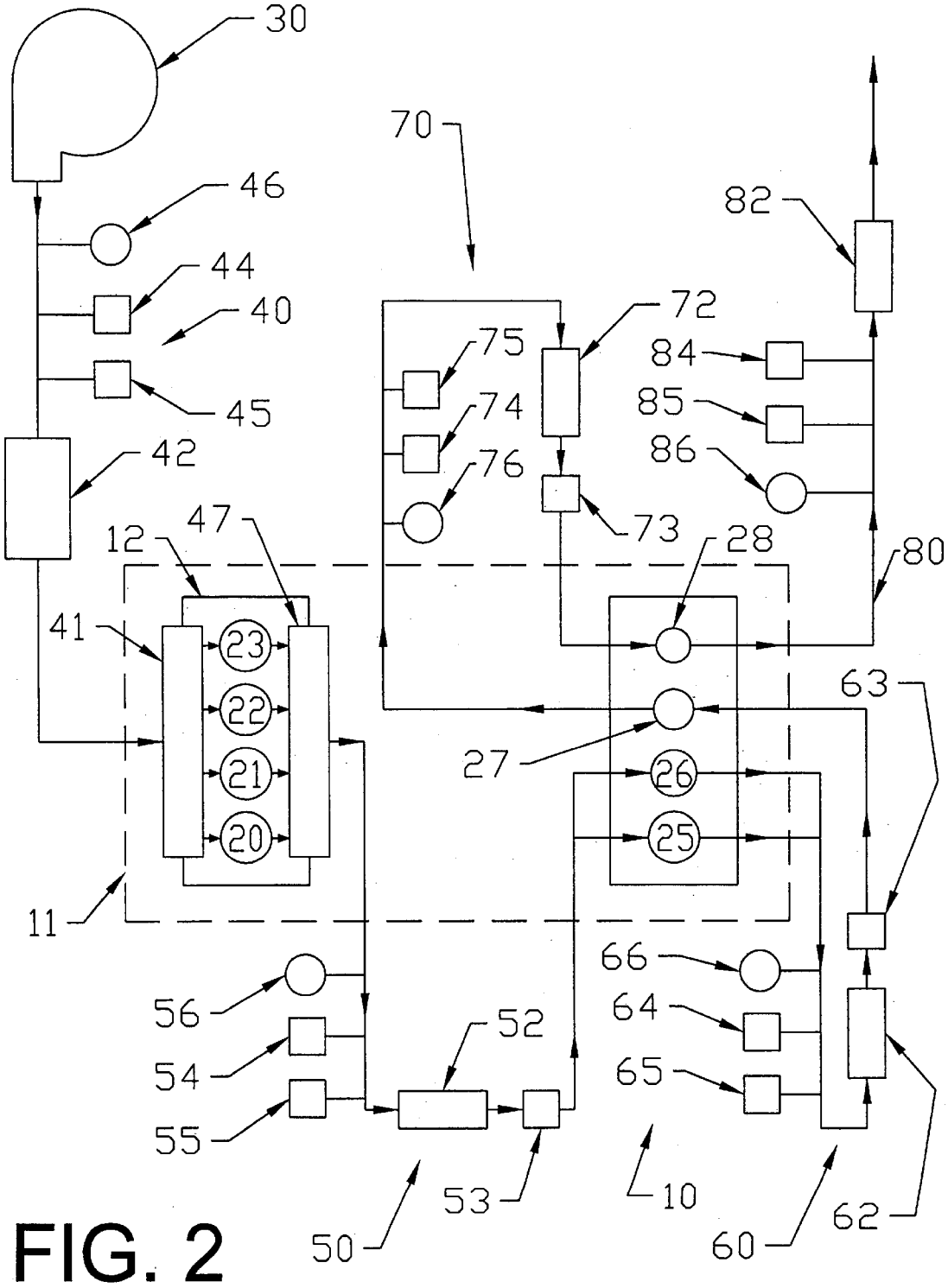
FIG. 2 is a diagrammatic illustration of the preferred five stage compression system of FIG. 1 to further illustrate the means interconnecting the five stages of compression.

FIG. 2 diagrammatically illustrates the interstage connection means. As illustrated by FIG. 2, the five stage compressor system of the invention includes a first means 40 connecting the compressed gas output of blower 30 with the intake manifold 41 for cylinders 20, 21, 22, 23. The preferred first means 40 preferably includes an intercooler 42 to further cool and compress the compressed gas output of the first stage blower 30 prior to its further compression by the second stage of compression, comprising the pistons and cylinders 20, 21, 22, 23. The preferred first means 40 also includes a relief valve 44 to prevent the pressure of the first stage compressed gas from exceeding desired upper limits, a remotely operable dump valve 45 to remove pressure from the system and a pressure gauge 46 so that operating personnel may monitor the output pressure of the centrifugal blower 30.

The system also includes a second means 50 interconnecting the exhaust manifold 47 and the compressed gas output of cylinder-pistons 20, 21, 22, 23 with the cylinder-pistons 25, 26 of the second bank of cylinders 13, which operate as the third stage of compression. The second means 50 preferably includes an intercooler 52 to cool and further compress the compressed gas of the second stage of compression and a moisture separator 53 to remove unwanted moisture from the second stage of compressed gas. The second means further includes a relief valve 54 to prevent the pressure of the second stage of compressed gas from exceeding an unwanted pressure, a remotely operable dump valve 55 to remove pressure from the system, and a pressure gauge 56 to permit operating personnel to monitor the pressure of the second stage of compression.

As illustrated by FIG. 2, the cylinder-pistons 25, 26 of the second bank of cylinders 13 are connected in parallel to receive the second stage compressed gas from second means 50 and exhaust their outputs in parallel to a third interconnection means 60, leading to the fourth stage of compression, which comprises cylinder-piston 27. The third interconnection means 60 preferably includes an intercooler 62 and a moisture separator 63 for the same reasons previously stated for the first and second means. The third interconnection means 60 likewise preferably includes a relief valve 64, a remotely operable dump valve 65 and a pressure gauge 66 for the same reasons previously set forth for the corresponding elements of the first means 40 and second means 50.

The output of the fourth stage of compression, comprising cylinder-piston 27, is connected to the fifth stage of compression or output stage 28 by a fourth interconnection means 70 which preferably includes an intercooler 72, moisture separator 73, pressure relief valve 74, remotely operable dump valve 75 and pressure gauge 76 for the same reasons set forth above for the use of the corresponding elements of the first, second and third means 40, 50, 60.

The interstage connection means 40, 50, 60 and 70 may also include temperature gauges or remotely readable temperatures means, which are not shown in the figures.

The output 80 of the fifth stage cylinder-piston 28 may be connected directly to a storage tank or to an apparatus to be operated by the compressed gas output of the five stage compressor 10, but preferably is supplied through an aftercooler 82 and can be provided with a relief valve 84 to avoid excess output pressures, a remotely operable dump valve 85 to allow pressure to be removed from the system and a pressure gauge 86 permitting system users to monitor the output pressure of the system.

A control console (not illustrated) may be provided with controls for operation of the external power source 15 and the remotely operable dump valves 45, 55, 65 and 75, and with gauges to show interstage and output pressures, interstage temperatures and other operating parameters.

Testing has indicated that with such a preferred five-stage compressor of the invention performance was increased by over 80%, compared with prior art systems, and this increase of performance was accomplished without an appreciable increase in size, weight or cost. For example, Hurricane Compressors Production Model 903–84 develops 330 cfm of compressed air at 2,000 psi, however, with the preferred five-stage compressor of this invention, including a belt-driven centrifugal blower as the first stage of compression, with minor changes to interstage pressures of the latter four stages of compression, an output of 600 to 1,000 cfm was obtained at 2000 psi, and the input horsepower per 100 cfm was reduced from 68 horsepower per 100 cfm to 59 horsepower per 100 cfm. Applications for such five-stage high pressure, high flow compressors include servicing of oil and gas rigs, whereby the high pressure, high flow output of such a five-stage gas compressor is used to expel collected debris from oil and gas wells, which otherwise interferes with the flow and productivity of such wells.

Thus, the invention provides a multi-stage, high flow, high pressure gas compressor comprising a compressor block 11 having a plurality of cylinders, which may be any number and in any configuration (e.g., V-block, straight block or round block), each of the plurality of cylinders containing a reciprocatable piston connected to a crankshaft that may be driven by an external power source to reciprocate within the cylinder. Each of the cylinders is provided with valve means to control the flow of gas into and out of the cylinder, and the cylinders of the block are interconnected in series so their pistons, when driven, further compress a flow of compressed gas directed to a first one of the plurality of cylinders to provide a compressed gas output, and a centrifugal blower provides a flow of compressed gas to the first one of the cylinders of the engine block as a first stage of compression. The centrifugal blower is driven by a mechanical drive connected between the crankshaft of the compressor block and the centrifugal blower, and mechanical drive and centrifugal blower are adapted to provide first stage compressed gas at high flow rates of up to 1,000 cu. ft. per minute and more. The external power source for driving such multi-stage compressors can be internal combustion engines or electric or hydraulic motors.

Figure 3:
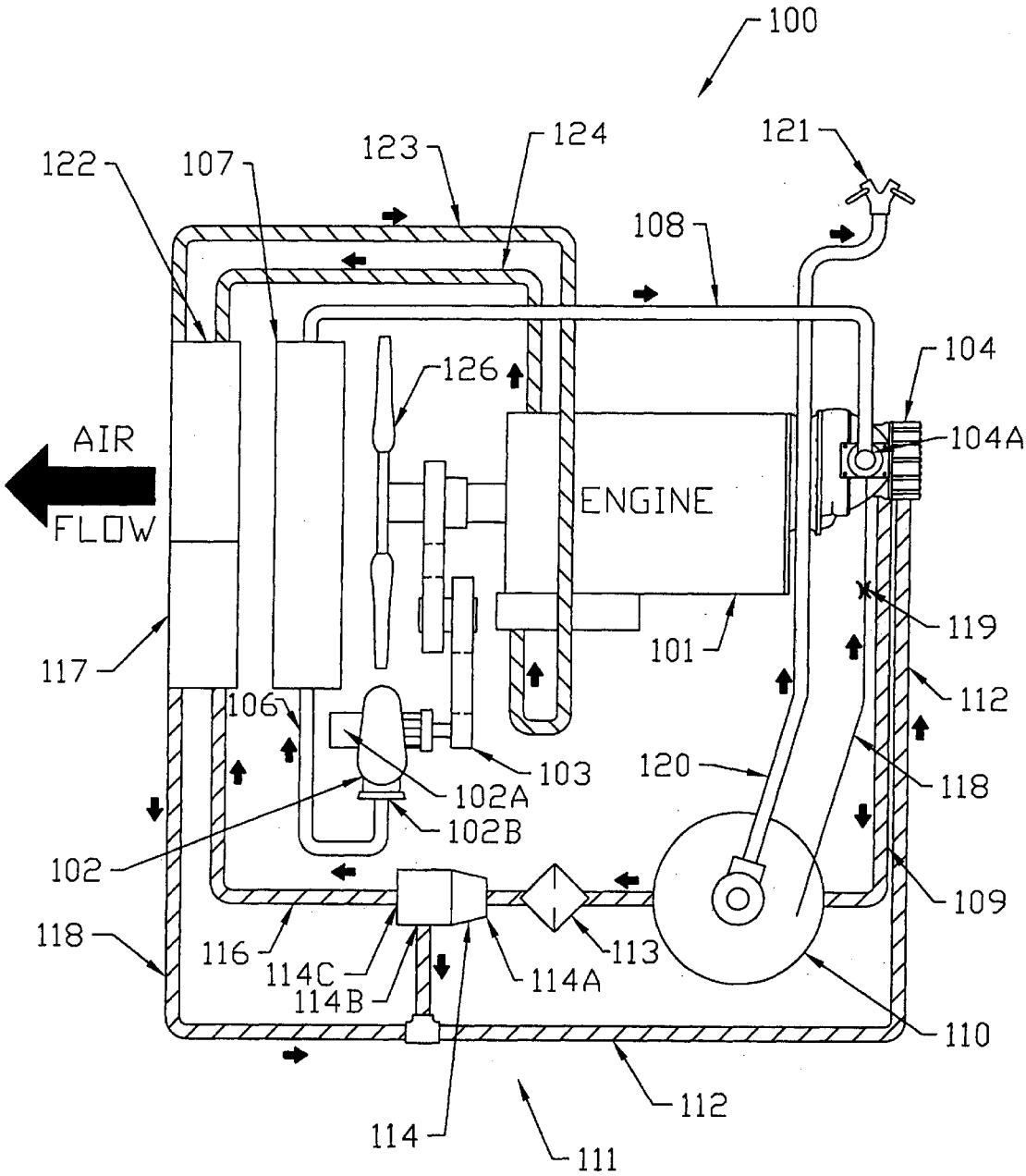
FIG. 3 is a diagrammatic drawing of a preferred two-stage high flow rate compression system of the invention.

FIG. 3 illustrates a preferred two-stage embodiment of the invention, which comprises a multi-stage air compressor assembly 100. As illustrated in FIG. 3, the two-stage air compressor assembly includes an internal combustion engine 101, a centrifugal blower 102, driven by a mechanical connection 103, from the internal combustion engine 101, and a rotary screw compressor 104, which is also mechanically connected to and driven by the internal combustion engine 101. The centrifugal blower 102 has an inlet 102*a* which is connectable with the air source, but is open to atmosphere as shown in FIG. 3. The centrifugal blower also has an outlet 102*b*, which provides a compressed air output as a first stage of compression of the two-stage air compressor assembly 100. As illustrated in FIG. 3, the compressed air output of the centrifugal blower 102 is carried by conduit 106 to an intercooler 107, which cools and further increases the pressure of the compressed air outlet of the centrifugal blower. The cooled and further pressurized compressed air from the intercooler 107 is carried by further conduit 108, as indicated by the arrows on FIG. 3, to the input 104*a* of the rotary screw compressor. Thus, the rotary screw compressor is connected with the compressed air output of the centrifugal blower and provides a second stage of compression and a further compressed air output, which is directed through conduit 109 to an oil separation means 110.

As known in the art, the rotary screw compressor 104 is provided with lubricating, cooling and sealing oil from an oil supply means 111, which is connected with the oil separation means 110. With the combined action of the oil separation means 110 and oil supply means 111, lubricating, cooling and sealing oil is directed to the rotary screw compressor 104 through conduit 112 and is carried from the rotary screw compressor 104 through conduit 109 with the output flow of compressed air. In oil separation means 110, the lubricating, cooling and sealing oil is separated from the compressed air. The separated lubricating, cooling and sealing oil flows from a sump in the oil separation means 110 through an oil filter 113 to a temperature control valve 114, having an input 114*a*, connected with the oil filter 113, a first output 114*b*, connected with the oil conduit 112 leading to the rotary screw compressor 104. A second output 114*c* of the oil temperature control valve 114 is connected to a conduit 116 leading to an oil cooler 117, whose output is connected to a conduit 118 returning to the oil supply conduit 112 leading to the rotary screw compressor 104. Thus, through the action of the oil temperature control valve 114, the lubricating, cooling and sealing oil for the rotary screw compressor 104 can be prevented from exceeding desirable limits in temperature by directing overly hot oil through the second output 114*c* and the oil cooler 117.

The compressed air output of the two-stage air compressor assembly 100 can be taken from the oil separation means 110 through a conduit 120, which leads to a service valve 121 to which air-operated apparatus may be connected. The rotary screw compressor 104 is also connected with the oil separation means 110 by means of a scavage line 118 through restrictive orifice 119.

Other elements of the preferred two-stage air compressor assembly 100, illustrated in FIG. 3, include a radiator 122, connected through conduits 123 and 124 with the internal combustion engine 101 and its coolant pump, so that in operation, engine coolant is carried to the radiator 122 to prevent the engine 101 from overheating. As illustrated in FIG. 3, the engine 101 also drives a fan 126, which directs a flow of air through the intercooler 107, the oil cooler 117 and the coolant radiator 122 for cooling the compressed air output of the centrifugal blower 102, the lubricating, cooling and sealing oil for the second stage rotary screw compressor 104 and the engine coolant.

The mechanical connection 103 between the internal combustion engine 101 and the centrifugal blower 102 preferably includes, as illustrated in FIG. 1 and described above, a belt drive system including a two-step shiv 33, including a first belt 34 between a first pulley 35 connected to the drive shaft of the internal combustion engine and a second pulley 36 connected with a third pulley 37 to step-up the rate of rotation between the internal combustion engine driveshaft and the axle 32 of the centrifugal blower 102 and its connected pulley 33, as set forth above in the description of the preferred five-stage embodiment of the invention. As noted above, the two-step shiv and belt design provides the required "belt rap" and rate of rotation step-up to run the blower, providing compressed gas flow rates of several hundred cfm, generally at speeds in excess of 9,000 rpm from crankshaft speeds on the order of 1,800 rpm.

In the preferred two-stage gas compressor assembly of the invention, the centrifugal blower may be obtained from Accessible Technologies, Inc. of Kansas City, Mo., their Model No. D-1M, which can provide output pressures of from 15 to 20 psi and flow rates of 750 cfm, which are preferable in the preferred two-stage gas compressor assembly illustrated herein, and the rotary screw compressor may be obtained from the Tamrotor Company of Finland, their Model No. ENDURO 25 DG, which can provide outputs of 750 cfm, at pressures of from about 100 psi to about 125 psi. Such two-stage gas compressors can satisfy most commercial applications such as the operation of multiple sand blasters and painting apparatus used in the maintenance of steel bridge structures.

A preferred two-stage gas compressor assembly 100 as described above requires less power than a single stage unit operating at the same flow and with the same inlet discharge conditions, and permits the use of a smaller, less expensive diesel engine and a smaller, less expensive rotary screw compressor. Such a two-stage gas compressor assembly operating to provide 750 cfm of air at 100 psig costs about $8,000 less than a comparable compressor, even with the added costs of the centrifugal blower and intercooler. In addition, such a two-stage gas compressor assembly requires 5% less horsepower than a conventional single stage twin screw compressor of like capacity, and the weight of a portable two-stage gas compressor assembly is 1,500 lbs. less than a prior art portable compressor of similar performance.

As will be apparent to those skilled in the art, multi-stage compressor systems of the invention may be provided with other compressor components, valve means and conduits, pressure regulators and the like, and the scope of the invention is limited only by the scope of the claims that follow.

What is claimed:

1. A five-stage, high flow rate, high pressure compressor, comprising:

a compressor block having a plurality of cylinders in two banks, including pistons connected with a crankshaft driven by an external power source, and valve means for controlling the flow of gas to and from the cylinders;

a centrifugal blower for providing a compressed gas output as a first stage of compression;

a mechanical drive connected between the crankshaft and the centrifugal blower;

first means connecting the centrifugal blower output with an intake manifold for the cylinders of one bank of cylinders of the compressor block, said pistons of one said bank of cylinders operating in parallel as a second stage of compression to further compress the compressed gas output of the centrifugal blower and to direct the further compressed gas to an exhaust manifold for said one bank of cylinders;

second means connecting the exhaust manifold of the first bank of cylinders with one or more of the cylinders of the second bank of cylinders, said one or more cylinders having a volume smaller than the cylinders of said first bank of cylinders, the one or more pistons of said one or more cylinders operating as a third stage of compression of said compressed gas;

third means connecting the compressed gas from said one or more cylinders with a further cylinder of said second bank of cylinders, said further cylinder having a volume smaller than said one or more cylinders, said piston of said further cylinder operating as a fourth stage of compression of said gas; and fourth means connecting the compressed gas from said further cylinder of said second bank of cylinders with an output cylinder of said second bank of cylinders, said output cylinder having a smaller volume than said further cylinder, said piston of said output cylinder operating as a fifth stage of compression of the compressed gas, and a fifth means for providing a compressed gas output at high flow rates and high pressures.

2. The compressor of claim 1, wherein the compressed gas output has a flow rate in excess of 600 cu. ft. per minute at a pressure in excess of 1000 psi.

3. The compressor of claim 1, wherein each of said first, second, third and fourth means comprises an intercooler, and the fifth stage is aftercooled.

4. The compressor of claim 1, wherein each of said first, second, third, fourth and fifth means comprises a pressure relief valve.

5. The compressor of claim 1, wherein each of said third, fourth and fifth means comprises a remotely operable dump valve.

6. The compressor of claim 1, further comprising a control console including pressure and temperature gauges connected with said first, second, third, fourth and fifth means, and means for operating dump valves connected with said first, second, third, fourth and fifth means.

7. The compressor of claim 1, wherein each of the second, third and fourth means comprises a moisture separator.

8. The compressor of claim 1 wherein said mechanical drive comprises a belt drive with a two-step shiv including a first belt between a first pulley connected to the crankshaft and a second pulley, and a second belt connected between a third pulley, driven by the second pulley, and a fourth pulley mechanically driving the centrifugal compressor.

9. The compressor of claim 1, further comprising an aftercooler, pressure relief valve, pressure gauge and remotely operable dump valve in the compressor output.

10. A multi-stage, high flow gas compressor, comprising a compressor block having a plurality of cylinders, each of the plurality of cylinders containing a reciprocatable piston connected to a crankshaft that may be driven by an external power source to reciprocate within the cylinder, each of the cylinders being provided with valve means to control the flow of gas into and out of the cylinder;

said cylinders of said compressor block being interconnected in series so their pistons, when driven, further compress a flow of compressed gas directed to a first one or more cylinders of said plurality of cylinders to provide a compressed gas output;

a centrifugal blower for providing a flow of compressed gas to said first one or more of said cylinders; and a mechanical drive connected between said crankshaft and said centrifugal blower, said mechanical drive operating said centrifugal blower at speeds in excess of 9000 rpm as a first stage of compression.

11. The compressor of claim 10, wherein said engine block comprises a V-block having a portion of said plurality of cylinders in each of two banks, one of said banks of cylinders comprising said first one or more cylinders, with their outputs connected in parallel as a second stage of compression.

12. The compressor of claim 11, wherein the cylinders of the second bank of cylinders are connected in series with the outputs of the plurality of cylinders of said one bank of cylinders and provide additional stages of compression for the compressed gas output.

13. The compressor of claim 10, wherein the flow of gas from said centrifugal blower to said first one or more plurality of cylinders is cooled by an intercooler.

14. The compressor of claim 11, wherein the flow of gas from the cylinders of said one of the banks of cylinders is cooled by an intercooler.

15. The compressor of claim 12, wherein the cylinders of the second bank of cylinders are connected in series with interconnection means comprising intercoolers and moisture separators.

16. The compressor of claim 15, wherein the interconnection means include pressure relief valves and remotely operable dump valves.

17. The compressor of claim 10 wherein said mechanical drive comprises a two-step shiv including a first belt between a first pulley connected to the crankshaft and a second pulley, and a second belt connected between a third pulley, driven by the second pulley, and a fourth pulley mechanically driving the centrifugal compressor.

* * * * *